US005078384A

United States Patent [19]

Moore

[11] Patent Number: 5,078,384

[45] Date of Patent: Jan. 7, 1992

[54] COMBINED DIFFERENTIAL DESKEWING AND NON-DIFFERENTIAL REGISTRATION OF SHEET MATERIAL USING PLURAL MOTORS

[75] Inventor: Steven R. Moore, Rochester, N.Y.

[73] Assignee: Xerox Corporation, Stamford, Conn.

[21] Appl. No.: 608,859

[22] Filed: Nov. 5, 1990

[51] Int. Cl.[5] ..... B65H 7/02; G03G 21/00

[52] U.S. Cl. ..... 271/228; 355/317

[58] Field of Search ..... 355/308, 317; 271/227, 271/228, 119, 256, 258

[56] References Cited

U.S. PATENT DOCUMENTS

| | | | |
|---|---|---|---|
| 3,156,463 | 11/1964 | Masterson et al. | 271/119 X |
| 3,593,988 | 7/1971 | Collins | 271/119 X |
| 3,861,670 | 11/1975 | Kraft | 271/122 |
| 4,128,327 | 12/1978 | Sugiyama et al. | 355/309 |
| 4,155,440 | 5/1979 | Bogdarski et al. | 198/399 |
| 4,391,510 | 7/1983 | Cherian | 355/317 |
| 4,438,917 | 3/1984 | Janssen et al. | 271/227 |
| 4,472,049 | 1/1984 | Houna et al. | 271/256 X |
| 4,487,407 | 12/1984 | Baldwin | 271/233 |
| 4,500,086 | 2/1985 | Garavuso | 271/225 |
| 4,511,242 | 4/1985 | Ashbee et al. | 271/227 X |
| 4,971,304 | 11/1990 | Lofthus | 271/227 |

FOREIGN PATENT DOCUMENTS

| | | | |
|---|---|---|---|
| 0136454 | 6/1987 | Japan | 271/258 |

*Primary Examiner*—A. T. Grimley
*Assistant Examiner*—J. E. Barbow, Jr.
*Attorney, Agent, or Firm*—Duane C. Basch

[57] ABSTRACT

A method and apparatus for deskewing and registering a copy sheet, including the use of two or more selectably controllable drive rolls operating in conjunction with sheet skew and lead edge sensors, for frictionally driving and deskewing sheets having variable lengths. Subsequently, said sheets will be advanced so as to reach a predefined registration position at a predetermined velocity and time, at which point said sheets will no longer be frictionally engaged by said drive rolls.

11 Claims, 6 Drawing Sheets

FIG. 2
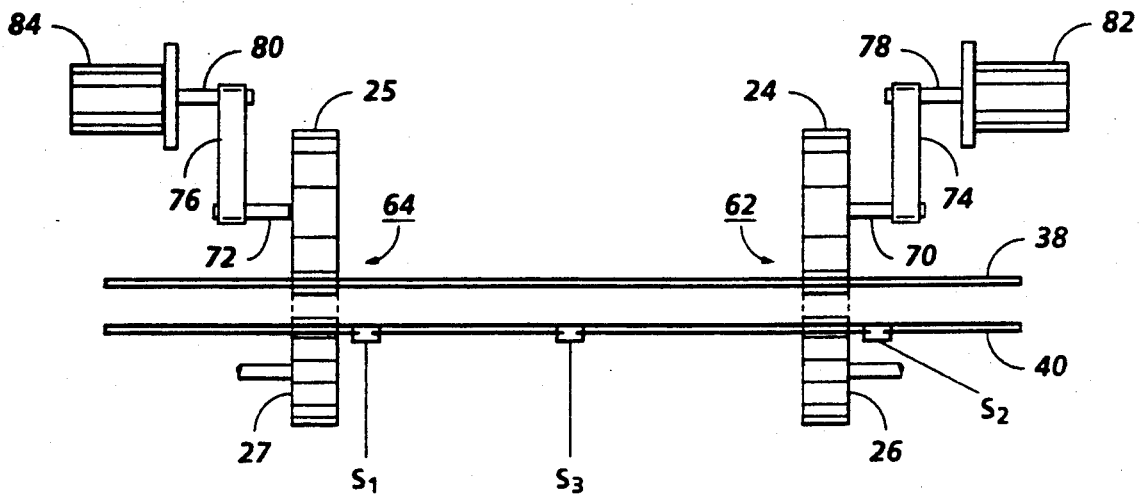
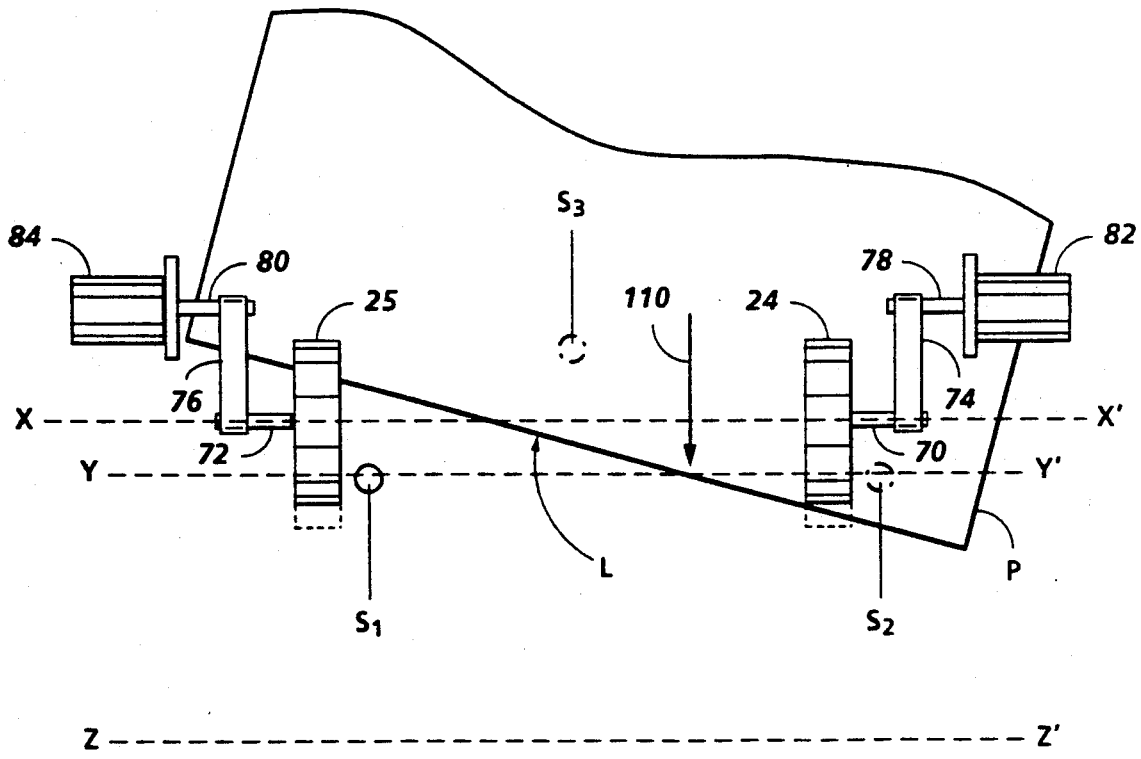
FIG. 3

COMBINED DIFFERENTIAL DESKEWING AND NON-DIFFERENTIAL REGISTRATION OF SHEET MATERIAL USING PLURAL MOTORS

This invention relates generally to an electrophotographic printing machine, and more particularly to a deskewing and lead edge registration system for presenting substrates or sheets to a print forming section of the printing machine.

In the past, paper handling devices of the type including electrophotographic printing machines have incorporated some type of registration system to properly register the copy sheet with a developed image to enable the accurate transfer of the image to the sheet. With reference to a reprographic processor, it will be appreciated that the registration of copy sheets must include, for example, synchronization of the copy sheet lead edge with the lead edge of the image developed on the photoreceptor, in conjuction with deskewing of improperly fed sheets.

For example, U.S. Pat. No. 4,128,327 to Sugiyama et al. teaches the use of primary and secondary rollers for the advancement of a copy sheet to the photoreceptor in an electrophotographic system. The secondary rollers, located between the primary rollers and the photoreceptor, are driven continuously at the process speed. After the sheet enters the secondary rollers, the primary rollers stop driving, allowing the sheet to be driven by the secondary rollers to synchronize the sheet with the image on the photoreceptor. In a similar embodiment, U.S. Pat. No. 4,391,510 to Cherian discloses the use of dual magnetically actuated voice coils, the plungers of which are used to register and deskew sheets which are subsequently forwarded toward the photoreceptor in synchronism with the image on the photoreceptor. A final example of a sheet registration system is disclosed in U.S. Pat. No. 4,487,407 to Baldwin, where a trail edge registration is accomplished by incorporating drive belts having pin-like members extending therefrom are used to advance and register a sheet via contact with its trailing edge.

In a typical sheet feeding and deskewing system, it is commonly known to use multiple, differentially driven rollers to introduce rotation in the sheet being fed. For example, U.S. Pat. No. 4,438,917 to Janssen et al. discloses a device for feeding sheets with a pair of independently controlled servo-motors, whereby each motor drives a nip roller which transports the copy sheet. Sensors are disposed in the transport path to generate signals, indicative of the sheet position, whereby said signals are in turn fed to the servo-motor controller for differentially controlling the rollers to achieve sheet alignment. In addition, Lofthus describes a related deskewing and side-registering system in U.S. Pat. No. 4,971,304 the relevant portions of which are incorporated herein by reference.

Moreover, U.S. Pat. No. 4,500,086 to Garavuso discloses a rotating inverter mechanism, having a drive shaft and a pair of spaced apart collars, each collar providing a mount for primary and secondary rollers, whereby the primary roller is driven in a clockwise direction while the secondary roller is driven in a counterclockwise direction. Initially, a sheet is transported by contacting the primary rollers. Upon actuating a sensor, one of the collars is pulled through a predetermined angle, causing the primary roll to lose contact with the sheet, while the secondary roller contacts the sheet. The two rollers in contact with the sheet, having opposite directions of rotation, thereby cause the sheet to be rotated about a central point between the collars.

In general the aforementioned patents do not address the problem of smearing or smudging caused by slippage of the copy sheet with respect to the photoreceptor subsequent to the tacking of a copy sheet to the charged photoreceptor. More specifically, any relative mismatch in velocities of the photoreceptor surface and the sheet would result in smearing of the image transferred to the copy sheet, caused for example, by the sheet being under control of the registration rollers while simultaneously being tacked to the photoreceptor.

In additional sheet feeding systems, for example, U.S. Pat. No. 4,155,440 to Bagdanski et al., a document handling device is adapted to turn a letter through an angle of 90 degrees by means of a plurality of feed rollers being driven at different effective speeds. Moreover, the device includes a pair of shafts having "D" shaped take-away rollers mounted thereon. The rollers on the shafts are respectively biased towards one another and are adapted to be driven by a one revolution clutch coupled to the shaft, whereby a letter disposed between the respective rollers would be transferred to the next processing station.

Yet another sheet feeding apparatus is disclosed in U.S. Pat. No. 3,861,670 to Kraft, where a single sheet is fed from a stack of sheets by moving the stack into engagement with a feed roller. A retard roller contacts the feed roller to define a nip therebetween, such that the feed roller contacts the uppermost sheet of the stack, while the retard roller prevents the feeding of multiple sheets by the feed roller. The retard roller may be configured in the shape of a horseshoe rather than a cylinder.

From the aforegoing discussion, one can easily see that it would be extremely valuable to be able to deskew and register copy sheets, having variable lengths in the process direction, with a developed image contained on the surface of a photoconductor, without driving the sheet subsequent to the initial tacking of the sheet to the surface of the photoconductor. Furthermore, such a system would avoid damaging the copy sheet due to physical contact with the lead or trail edges of the sheet.

Accordingly, and in accordance with the present invention, a method and apparatus for deskewing and registering sheets is disclosed that includes the use of two or more selectably controllable drive rolls operating in conjunction with sheet skew and lead edge sensors, for frictionally driving the sheets having variable lengths at a constant velocity to a predetermined registration position after substantially eliminating the skew of the sheets.

Other advantages of the present invention will become apparent after studying the following description taken in conjunction with the accompanying drawings wherein the same reference numerals have been applied to like parts and wherein:

FIG. 2 is an end view of the deskewing and registration arrangement of the present invention taken along lines 2—2 of FIG. 1;

FIG. 3 is a top view of the deskewing and registration arrangement, and the associated paper path;

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
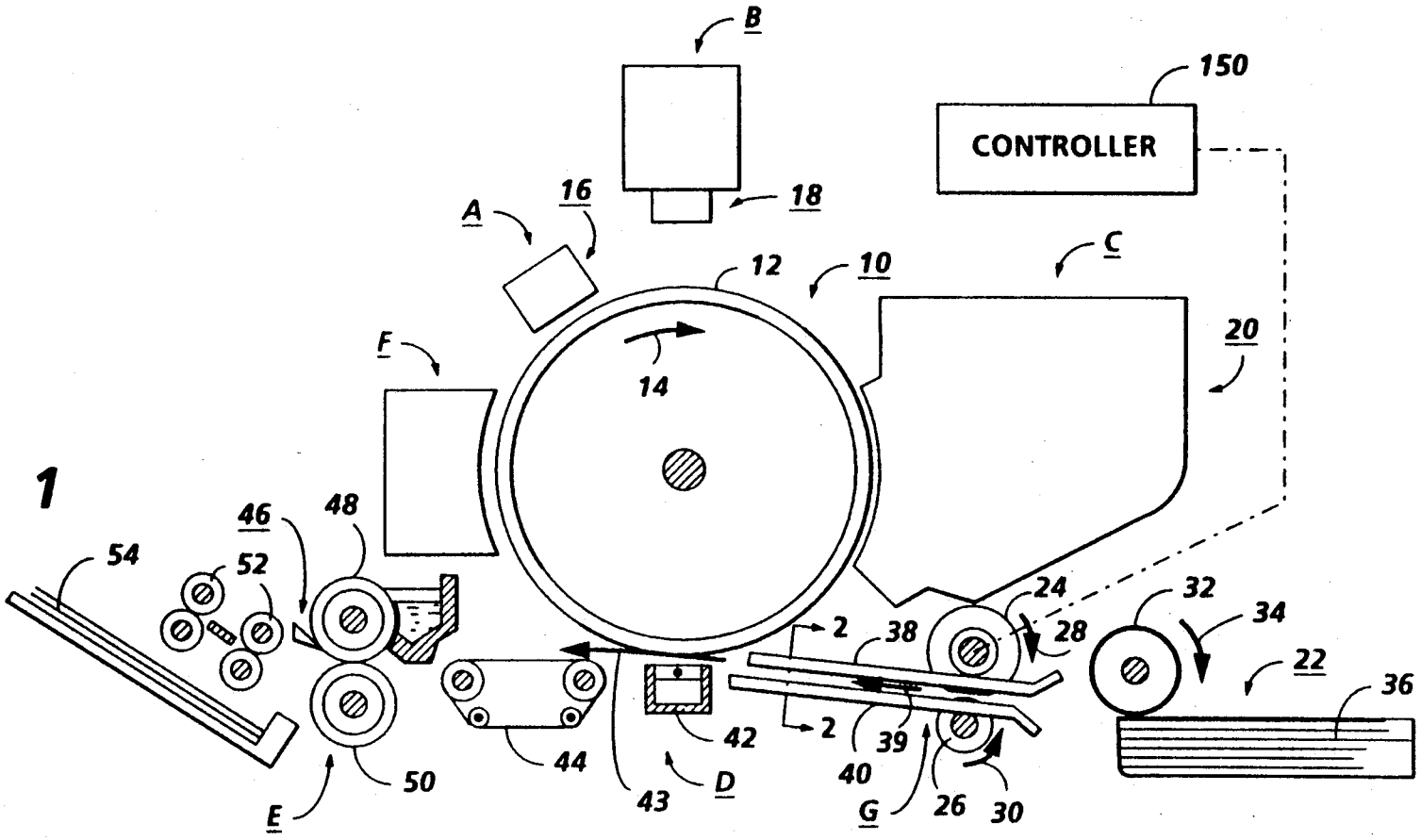
FIG. 1 is a schematic elevational view of an electrophotographic printing machine incorporating the present invention.

For a general understanding of an electrophotographic printing machine in which the features of the present invention may be incorporated, reference is made to FIG. 1, which schematically depicts the various components thereof. Although the apparatus for deskewing and registering copy sheets is particularly well adapted for use in the machine of FIG. 1, it should be evident from the following discussion that it is equally well suited for use in a wide variety of devices.

In the electrophotographic machine of FIG. 1, a drum 10 having a photoconductive surface 12, is rotated in the direction indicated by arrow 14 through the various processing stations for producing a copy of an original document. Initially, drum 10 rotates photoconductive surface 12 through charging station A, which employs a corona generating device 16 to charge surface 12 to a relatively high and substantially uniform potential.

Thereafter, drum 10 rotates the charged portion of photoconductive surface 12 through exposure station B, where exposure mechanism 18 illuminates the charged surface to produce an electrostatic latent image corresponding to the informational areas of the original document. For example, exposure mechanism 18 may include a stationary, transparent platen for supporting the original document, illumination lamps, and an oscillating mirror and lens assembly that moves in a timed relationship with the photoconductive surface to create incremental light images which are projected through an aperture to charged photoconductive surface 12.

Drum 10 then rotates to cause the electrostatic latent image on photoconductive surface 12 to pass through development station C. Development station C includes a developer unit, indicated generally by reference numeral 20, having a housing for a supply of development material. The developer material generally comprises magnetic carrier granules with toner particles adhering triboelectrically thereto. Developer unit 20 is preferably a magnetic brush development system where the developer material is moved through a magnetic flux field causing a brush to form, whereby the latent electrostatic image on photoconductive surface 12 is developed by bringing surface 12 into contact with the brush. In this manner, the toner particles are electrostatically attracted to the latent image thereby forming a developed toner image on photoconductive surface 12.

Coincident with development of the toner image, a copy sheet is advanced by sheet feeding apparatus 22 to transfer station D. In operation, feed roller 32 rotates in the direction of arrow 34 to advance the uppermost sheet from stack 36 to the deskewing and registration station G, where individual sheets are deskewed and fed into position by two or more roller pairs, comprised of rollers 24 and 26, so as to register the sheet with the developed toner image contained on photoconductive surface 12. Generally, the roller pairs are differentially driven by separate motors (not shown) to deskew and feed the sheet through a path formed by guides 38 and 40 in the direction indicated by arrow 39. Generally, the sheet is advanced until sufficiently tacked to the photoconductive surface at transfer station D.

Transfer station D includes a corona generating device 42 which applies a spray of ions to the back side of the sheet, causing the sheet to become tacked to photoconductive surface 12, while attracting the toner powder image to the front surface of the sheet. Subsequently, the sheet is stripped from the photoconductive surface and advanced in the direction of arrow 43 by endless belt conveyor 44, to fusing station E.

Fusing station E includes a fuser assembly 46 having a fuser roll 48 and backup roll 50 defining a fusing nip therebetween. Subsequent to the fusing process, the copy sheet is advanced by rollers 52 to catch tray 54.

After separation of the copy sheet from photoconductive surface 12, residual toner will invariably remain on the photoconductive surface, thereby requiring a cleaning operation for removal of the residual toner. Cleaning station F includes a corona generating device (not shown) for neutralizing the electrostatic charge remaining on the photoconductive surface, as well as, that of the residual toner particles. The neutralized toner particles may then be cleaned from photoconductive surface 12 by a rotatably mounted fibrous brush (not shown) in contact therewith. After cleaning, photoconductive surface 12 is exposed to an erase lamp (not shown), the light emitted therefrom serving to dissipate any residual electrostatic charge remaining on the photoconductive surface prior to beginning the next imaging cycle.

Referring now to FIGS. 2 and 3, wherein the deskewing and registration arrangement of the present invention is illustrated, sheet P is advanced in the direction of arrow 110 between guides 38 and 40. Generally, a pair of nip roll pairs 62 and 64, each respectively comprising driving rollers 24 and 25, and idler rollers 26 and 27, are employed to frictionally engage sheet P therebetween.

Driving rollers 24 and 25 are generally provided with a rubber or plastic surface suitable for substantially non-slipping engagement of the sheets passing therebetween. More specifically, drive rollers 24 and 25 are portrayed in FIG. 1 as D-shaped rollers having a flat or recessed portion on the outer circumference thereby resulting in a period during a single revolution in which no contact is made with the respective idler rollers, 26 and 27. In the present embodiment, drive rollers 24 and 25 have a diameter of 2.2 inches and a flat or recessed area occupying an angular arc of approximately 58°, resulting in an effective driving circumference of approximately 5.8 inches. Drive rollers 24 and 25 may be of any eccentric shape that suitably provides a temporary loss of contact with the respective idler roller for the purposes of the present invention.

Drive rollers 24 and 25 in FIGS. 2 and 3 are respectively supported for controllable rotation on drive shafts 70 and 72, which are drivingly engaged by independently controllable driving means such as motors 82 and 84 via timing belts 74 and 76, supported at one end by drive shafts 70 and 72, and at the other end on motor shafts 78 and 80, respectively. Motors 82 and 84 are generally similar in construction and operational characteristics, and in this particular embodiment comprise stepper motors.

The movement of sheet P is monitored by at least three sensors, $S_1$, $S_2$, $S_3$. Sensors $S_1$ and $S_2$ are suitably spaced on a line Y—Y', perpendicular to the direction of paper sheet travel, slightly downstream from the nip roll pairs. Sensors $S_1$ and $S_2$ are spaced apart by the same relative spacing of the nip roll pairs and are offset from the centerline of the sheet path so as not to interfere with the nip roll pairs or advancing sheet. Sensor $S_3$ is located upstream from the nip roll pair at a position centered between the nip roll pairs and offset from the centerline of the sheet path. In addition, sensor $S_3$ is placed at a position about 0.6 inches upstream from the nip centerline represented by line X—X', while sensors $S_1$ and $S_2$ are located at a position about 0.2 inches downstream from centerline X—X'. Sensors $S_1$, $S_2$, and $S_3$ are comprised of reflective optical sensors which will produce an active signal upon occlusion by paper sheets or the like.

Figure 4:
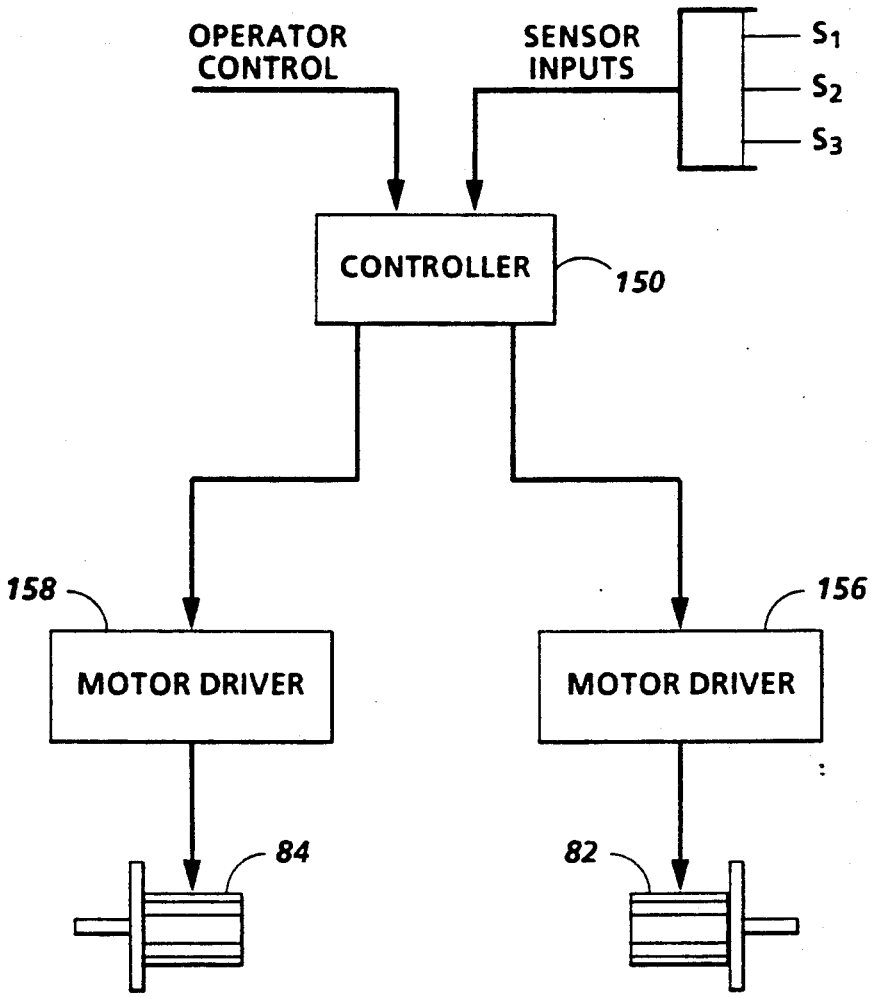
FIG. 4 is an illustration of the control arrangement for a preferred embodiment of the present invention.

Referring now to FIG. 4, where a control system suitable for use in the present invention is shown, controller 150 controls the operation of the reproduction machine, or a portion thereof, and is well known to comprise a microcontroller or microprocessor capable of executing control instructions. Moreover, controller 150 is suitable for monitoring the status of sensors $S_1$, $S_2$, and $S_3$ in accordance with the control instructions to produce a controlled output in response thereto. Such a control output is transmitted to motor driver boards 156 and 158, which in turn provide pulses to stepper motors 82 and 84, for the respective control of the required movement and rotational velocity of drive rollers 24 and 25.

Figure 5:
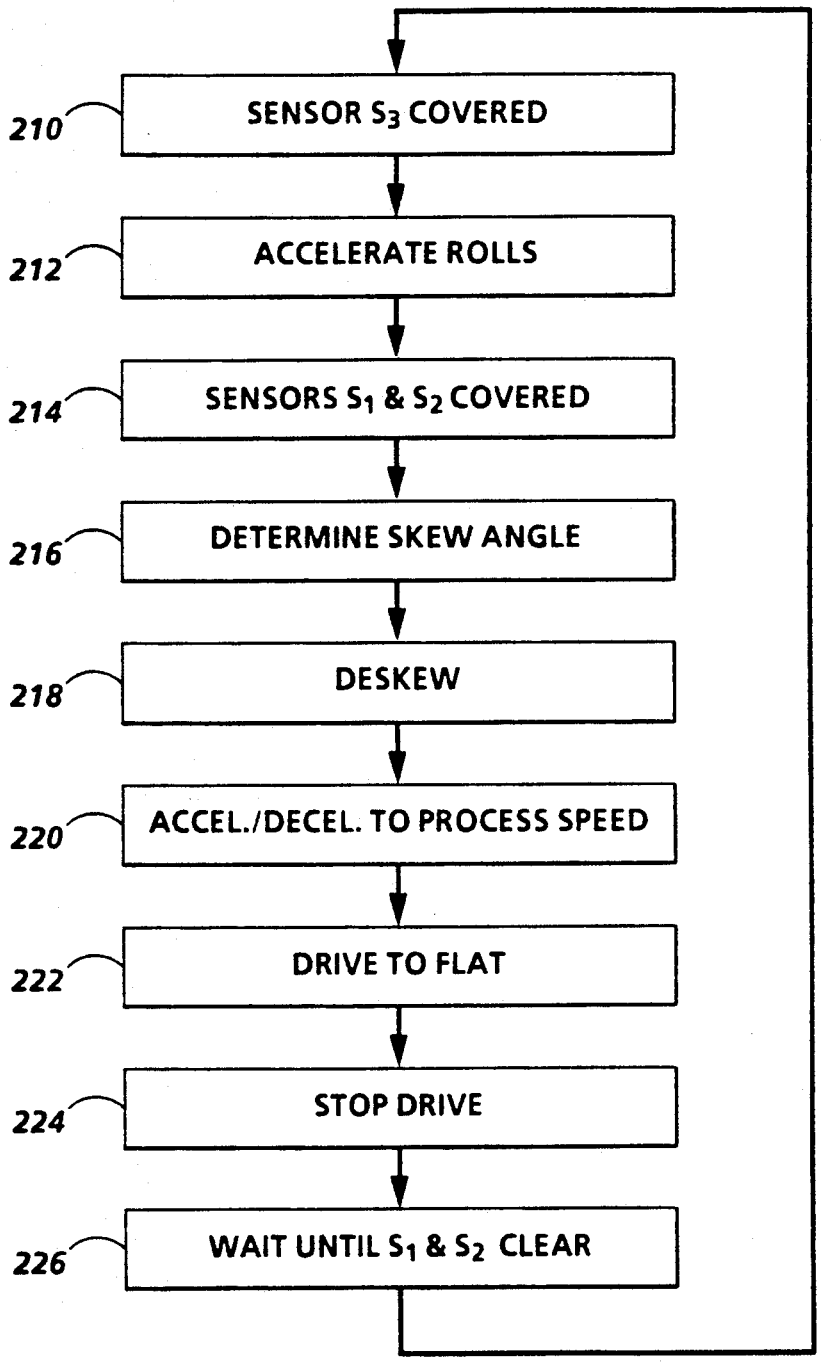
FIG. 5 is a flow chart depicting the sequence of operations in the present invention.
Figure 6A:
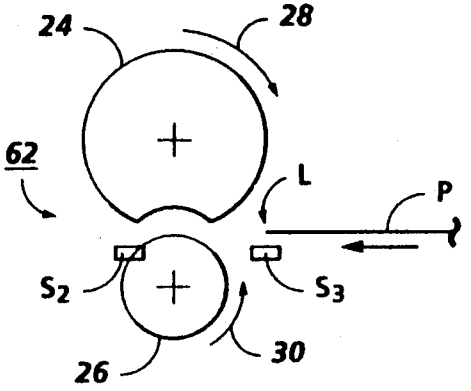
FIG. 6A–6E are illustrations of the relative positions of the drive rollers and copy sheet in the deskewing and registration station of the present invention.
Figure 6B:
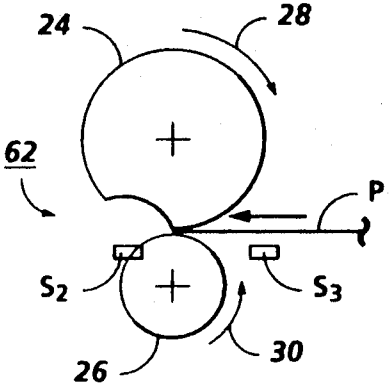
Figure 6C:
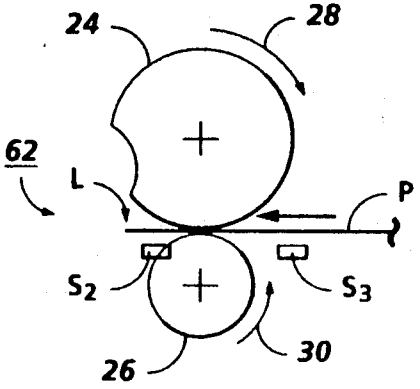
Figure 6D:
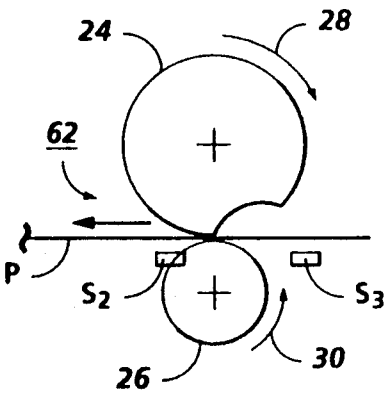
Figure 6E:
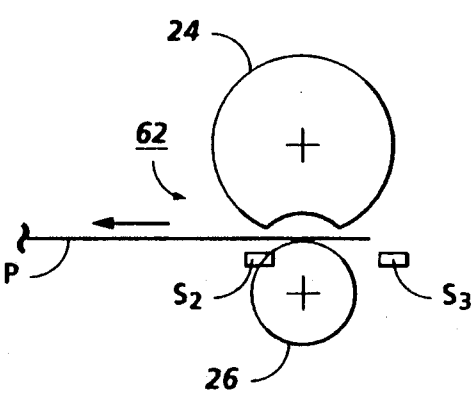
Figure 7:
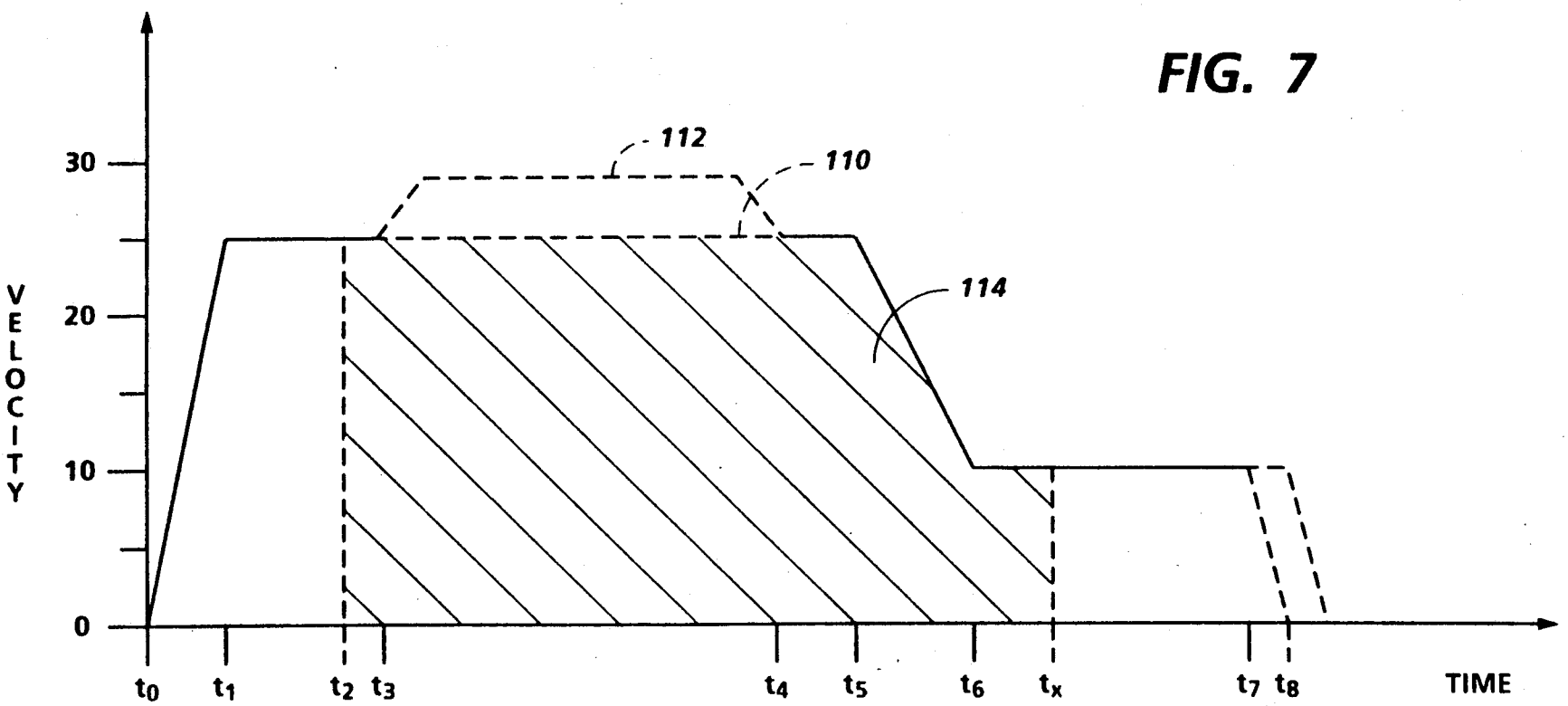
FIG. 7 is a plot representing the velocity of the sheet drive rollers of the present invention with respect to time.

In operation, the deskewing and registration apparatus operates in accordance with the flow chart of FIG. 5, which controls the relative rotational positions of drive roller 24 as sheet P passes between nip roll pair 62, as shown in FIGS. 6A–6E in accordance with the velocity/time profile of the drive rollers indicated in FIG. 7. As illustrated in FIG. 6A, lead edge L of sheet P, first occludes sensor $S_3$, thereby establishing time $t_0$ and signaling controller 150 at process step 210. Controller 150 immediately signals the motor driver boards to begin acceleration of the stepper motors, process step 212, so that drive rollers 24 and 25 are rotating at the sheet speed when the sheet reaches the drive roll nip, as illustrated in FIG. 6B and indicated as time $t_1$ in FIG. 7. In the example embodiment, the incoming sheet velocity is approximately 25 inches per second (in/sec). Consequently, the acceleration time for the drive rollers ($t_1$–$t_0$) must be approximately 0.01617 seconds, representing a sheet travel distance of approximately 0.4 inches.

In the example embodiment, the maximum correctable skew is limited to 100 milliradians (mrad), which translates to a potential of 0.4 inches of offset across the 4 inch spacing between rollers 24 and 25, when lead edge L reaches the respective drive roll nips. Generally, this potential skew is accounted for by positioning sensor $S_3$ at a position about 0.6 inches upstream from the drive roll nip centerline (X—X') to accomodate for the potential skew of the lead edge, as well as, the drive roll acceleration. It should be noted that the positioning of sensors, and remaining parameters associated with deskew and registration station G, are a function of the process parameters defined by the reprographic system in which the present invention would operate.

Upon engaging sheet P, drive rollers 24 and 25 are driven in a non-differential fashion to advance the sheet past sensors $S_1$ and $S_2$. Controller 150 detects the time at which both sensors $S_1$ and $S_2$ are occluded by sheet P at times $t_3$ and $t_2$ respectively, process step 214 and FIG. 6C, enabling the controller to determine the amount of skew present in the advancing sheet.

Subsequent to determining the amount of skew in lead edge L the controller will signal the respective motor driver boards to begin differentially driving the stepper motors at time $t_3$, in order to deskew sheet P in accordance with process step 218. As illustrated in FIG. 7, where velocity profiles 110 and 112 represent the differential velocities of drive rollers 24 and 25 respectively, drive roller 25 is accelerated to a higher velocity for a short period of time to deskew sheet P. More specifically, during the time period $t_3$–$t_4$ drive roller 25 is accelerated above and subsequently returned to the nominal sheet speed to cause the leftmost side of sheet P, as shown in FIG. 3, to travel a greater distance than the rightmost side, thereby substantially eliminating the initial skew of the sheet as presented to deskewing and registration section G. In the preferred embodiment, acceleration of drive rollers 24 and 25 is limited to a maximum of two times the acceleration due to gravity (772 in/sec$^2$) in order to prevent slippage between the drive rollers and the sheet.

At time $t_4$, therefore, the deskewing of sheet P should be complete and at some later time, for example $t_5$, the drive rollers are decelerated to an output process speed of 10 in/sec in the present embodiment, as indicated in FIG. 7 and process step 220 of FIG. 5. In general, the sheet may be accelerated or decelerated as required to achieve not only a desired sheet output velocity, but also to control the registration of the deskewed lead edge with the toner image present on photoconductive surface 12 of FIG. 1. The targeted registration position for the preferred embodiment is illustrated as line Z—Z' in FIG. 3. Once again, the system should impose a deceleration limit of 2 G's to avoid sheet slippage. Specifically, the time period defined by $t_5$ to $t_6$ is utilized to bring the velocity of sheet P to a desired output velocity, and the period is determined by the position of lead edge L relative to the time and position desired for the registration of the lead edge on photoconductive surface 12 (position Z—Z'). The relative position of lead edge L has been tracked by controller 150 with respect to the initial occlusion of sensor $S_2$, which established the position of the lead edge, and the subsequent controlled rotation of drive roller 24, whereby the the position of the lead edge at time $t_x$ with respect to sensor $S_1$ is indicated by the area under the velocity profile curve for roll 24, shaded area 114.

Having decelerated to the desired output velocity at time $t_6$, controller 150 then causes both drive rollers 24 and 25 to rotate at a constant velocity, process step 222, until reaching the position indicated by FIG. 6D and time $t_7$ of FIG. 7. At time $t_7$, lead edge L of sheet P should be in contact with photoconductive surface 12, being tacked thereto by the aforedescribed electrostatic forces. It is important to note that the velocity profile illustrated between time $t_5$ and time $t_7$ is dependent upon the relative position of lead edge L with respect to the toner image present on photoconductive surface 12. Ideally, lead edge L will be presented to transfer station D at line Z—Z' at a predetermined speed, 10 in/sec for the present embodiment, in synchronization with the toner image. Therefore, the actual shape of the profile between $t_5$ and $t_7$ is dependent upon the time at which the sheet was initially advanced to the control of deskew and registration station G.

Coincidentally, upon reaching the drive roller position portrayed in FIG. 6D, no additional advancement of the sheet will be accomplished by drive rollers 24 or 25. Accordingly, sheet P will advance as pulled by the rotation of drum 10, lead edge L of the sheet being tacked thereto, thereby enabling the deskew and registration of sheets having a variable length in the process direction without driving the sheet subsequent to the initial tacking of sheet P to photoconductive surface 12.

Subsequently, drive rollers 24 and 25 are advanced to the position indicated by FIG. 6E, where they are stopped, process step 224, to enable the trailing portion of sheet P to move through the respective nip areas unimpeded. Finally, controller 150 waits until sensors $S_1$ and $S_2$ become unoccluded, process step 226, before reinitializing the drive roll control loop at process step 210.

In a preferred embodiment, the circumference of drive rollers 24 and 25 is slightly oversized to accommodate the extra travel required to deskew the sheet. Hence, sheet P is frictionally driven past line Z—Z' during which time lead edge L is sufficiently tacked to photoconductive surface, the nominal length of this overlap zone being approximately 0.4 inches. In order to prevent smear of the toner image while lead edge L is in the overlap zone, the output velocity of the drive rollers may be biased to be 1-2% faster than the surface speed of drum 10 during the period $t_6$ to $t_7$. The relative mismatch in velocities of drum 10 and sheet P would result in the formation of a buckle in sheet P between line X—X' and line Z—Z'. In general the buckle formed during this relatively short period would be on the order of 0.078 inches for a 2% mismatch in velocity.

Thus, a method and apparatus is disclosed that facilitates the deskewing and registration of a copy sheet for the purpose of accurately presenting the sheet to accept a toner image from a photoconductive member in the reprographic machine. The method and apparatus include a plurality of sensors for determining the position of a copy sheet and a controller for analyzing the signals therefrom and controlling the rotation of two or more D-shaped drive rolls in frictional contact with the sheet.

The present invention has been described in detail with particular reference to a preferred embodiment thereof; however, it should be understood that variations and modifications can be effected within the spirit and scope of the instant invention.

I claim:

1. A combination sheet deskew and registration apparatus for deskewing and registering a sheet of unknown length having an initial skew of unknown magnitude and direction and unknown lead edge position along a process direction, said apparatus comprising:

selectably controllable drive means for frictionally driving the longitudinally oriented sheet in the process direction, said drive means being oriented along a common axis;

initial skew sensing means for detecting the initial skew of the sheet entering the apparatus;

lead edge tracking means for tracking the position of the lead edge of the sheet;

control means for selectably controlling said drive means for driving the sheet differentially and non-differentially, said control means controlling said drive means for differential driving first in response to initial sensing by said initial skew sensing means to remove initial skew, and second in response to said lead edge tracking means to register the lead edge of the sheet at a predetermined position; and means for substantially reducing the frictional driving force applied to the sheet when the lead edge of the sheet reaches said predetermined position.

2. The combination sheet deskew and registration apparatus of claim 1, wherein said control means selectably controls said drive means to cause the lead edge of the sheet to reach said predetermined position at a predefined constant velocity.

3. The combination sheet deskew and registration apparatus of claim 2, wherein said control means selectably controls said drive means to cause the lead the sheet to reach said predetermined position at a predefined time.

4. The combination sheet deskew and registration apparatus of claim 1, wherein said drive means further comprises at least two independently controllable and spaced apart sheet drive rollers, each of said sheet drive rollers having an independent idler roller in limited contact therewith for the formation of a sheet driving nip, whereby the sheet passing through said nip will be frictionally driven in the process direction.

5. The combination sheet deskew and registration apparatus of claim 4, wherein said sheet drive rollers comprise substantially circular rollers having an eccentric feature on the perimeter thereof, so that upon rotation of said drive rollers the normal contact force between said drive rollers and said idler rollers reaches zero once per revolution of said drive roller.

6. The combination sheet deskew and registration apparatus of claim 1, wherein said means for substantially reducing the frictional driving force comprises flat area extending longitudinally along the outer circumference of said sheet drive roller, whereby the normal contact force between said sheet drive roller and said idler roller is eliminated when said flat area reaches the nip region.

7. The combination sheet deskew and registration apparatus of claim 1, wherein said means for substantially reducing the frictional driving force comprises a concave recess extending longitudinally along the outer circumference of said sheet drive roller, whereby the normal contact force between said sheet drive roller and said idler roller is eliminated when said recessed area reaches the nip region.

8. An electrophotographic system having a combination sheet deskew and registration apparatus for deskewing and registering variable length copy sheets having initial skew of unknown magnitude and direction and unknown lead edge positions along a process direction, said apparatus comprising:

selectably controllable drive means for frictionally driving the copy sheets in the process direction;

initial skew sensing means for detecting the initial skew of the copy sheets entering the apparatus;

lead edge tracking means for tracking the position of the lead edges of the copy sheets;

control means for controlling the operation of the electrophotographic system, said control means further comprising means for selectably controlling said drive means for driving the sheets differentially and non-differentially, said control means controlling said drive means for differential driving first in response to initial sensing by said initial skew sensing means to remove initial skew, and second in response to said lead edge tracking means to register the lead edge of each sheet at a predetermined position; and means for substantially reducing the frictional driving force applied to the sheet when the lead edge of each sheet reaches said predetermined position.

9. The electrophotographic system of claim 8 wherein said control means selectably controls said drive means to cause the lead edge of the sheet to reach said predetermined position at a predefined constant velocity.

10. The electrophotographic system of claim 8 wherein said control means selectably controls said drive means to cause the lead edge of the sheet to reach said predetermined position at a predefined time.

11. In an electrophotographic system having a combination sheet deskew and registration apparatus, the method of deskewing and registering a copy sheet of unknown length having an initial skew of unknown magnitude and direction and an unknown lead edge position along a process direction, comprising the steps of:

sensing the lead edge of the copy sheet;

tracking the position of the lead edge of the copy sheet;

accelerating a pair of drive rollers to accept and frictionally advance the copy sheet at its input speed;

sensing the initial skew of the copy sheet entering the apparatus;

determining the angle of skew present in the copy sheet;

differentially driving said drive rollers in response to said angle of skew to remove said initial skew;

non-differentially driving said drive rollers to register the lead edge of the copy sheet at a predetermined position in synchronization with a toner powder image contained on a photoconductive member; and substantially eliminating the frictional driving force applied to the copy sheet when the sheet reaches said predetermined position.

* * * * *